United States Patent [19]

Fukuda et al.

[11] Patent Number: 4,965,164

[45] Date of Patent: Oct. 23, 1990

[54] METHOD FOR PRODUCING ELECTROPHOTOGRAPHIC PHOTORECEPTOR

[75] Inventors: Yuzuru Fukuda; Masayuki Nishikawa, both of Kanagawa, Japan

[73] Assignee: Fuji Xerox Co., Ltd., Tokyo, Japan

[21] Appl. No.: 306,979

[22] Filed: Feb. 7, 1989

[30] Foreign Application Priority Data

Feb. 10, 1988 [JP] Japan ..... 63-27422

[51] Int. Cl.[5] ..... G03G 5/082

[52] U.S. Cl. ..... 430/128; 430/58

[58] Field of Search ..... 430/57, 58, 69, 85, 430/84

[56] References Cited

U.S. PATENT DOCUMENTS 4,705,733 11/1987 Saitoh et al. ..... 430/57
4,816,341 3/1989 Nakayama et al. ..... 428/458

FOREIGN PATENT DOCUMENTS 54-78135 6/1979 Japan .
54-86341 7/1979 Japan .
55-87155 7/1980 Japan .
59-12446 1/1984 Japan .
62-9355 1/1987 Japan .
63-63051 3/1988 Japan .

*Primary Examiner*—John L. Goodrow
*Attorney, Agent, or Firm*—Finnegan, Henderson, Farabow, Garrett and Dunner

[57] ABSTRACT

A method for producing an electrophotographic photoreceptor is disclosed, which comprises the steps of forming a charge transporting layer comprising aluminum oxide on a substrate and then forming thereon a charge generating layer comprising mainly amorphous silicon, or alternatively forming a charge generating layer comprising mainly amorphous silicon on a substrate and then forming thereon a charge transporting layer comprising aluminum oxide, wherein the charge transporting layer is formed using a compound containing aluminum by the ion plating method while maintaining the substrate at 50° C. or more.

9 Claims, No Drawings

METHOD FOR PRODUCING ELECTROPHOTOGRAPHIC PHOTORECEPTOR

FIELD OF THE INVENTION

The present invention relates to a method for producing an electrophotographic photoreceptor carrying an charge transporting layer comprising aluminum oxide.

BACKGROUND OF THE INVENTION

In recent years, an amorphous silicone-based electrophotographic photoreceptor having a layer made mainly of amorphous silica has been receiving attention as a light-sensitive material. The reasons for this are that amorphous silicone itself has a possibility of radically improving the life factors of the conventional electrophotographic photoreceptor and if it is applied to an electrophotographic photoreceptor, there is a possibility of an electrophotographic photoreceptor being obtained, said photoreceptor having electrically stable repeating characteristics, being of high hardness and thermally stable and thus having a long service life. From this point of view, various amorphous silicone-based electrophotographic photoreceptors have been proposed a described in JP-A Nos. 54-78135 and 54-86341 (The term "JP-A" as used herein means an "unexamined published Japanese patent application).

Among these, electrophotographic photoreceptors is an amorphous silicone electrophotographic photoreceptor having a so-called function separated type light-sensitive layer, i.e., a light-sensitive layer consisting of charge generating layer to generate a charge carrier upon irradiation of light and charge transporting layer in which the charge carrier generated in the charge generating layer can be injected with high efficiency and further the charge carrier is efficiently movable. As the charge transporting layer of the function separated type amorphous silicone electrophotographic photoreceptor, for example, an amorphous silicone film with a film thickness of about 5 to 100 μm as obtained by decomposing a mixed gas of silane compound (e.g., silane or disilane) gas, carbon, oxygen or nitrogen-containing gas, and a small amount of Group III or V element-containing gas (e.g., phosphine or diborane) by glow discharging is used as described in JP-A No. 62-9355.

In general, in the electrophotographic photoreceptor divided into the charge transporting layer and the charge generating layer, the charge transporting layer with the largest film thickness among the light-sensitive layers is responsible for charging properties. However, charging properties of an electrophotographic photoreceptor using an charge-transporting layer of hydrogenated amorphous silicone film obtained by glow discharge decomposition of a silane compound as described above are such that the charge potential is about 30 V/μm or less, and thus are not sufficiently satisfactory. Moreover, its dark decay rate is generally about 20%/sec or more, which is markedly high, although it varies depending on the conditions of use. For this reason, an electrophotographic photoreceptor using such an amorphous silicone based electric charge transporting layer is limited to a relatively high-speed system in application, or it needs a specified developing system because a sufficiently high charged potential cannot be obtained. To increase the charged potential, it suffices to increase the thickness of the electric charge transporting layer. For this increasing the layer thickness, however, it is necessary to lengthen the production time and moreover, in accordance with the usual process of production, the possibility of formation of film defects due to the formation of such a thick film is increased, resulting in a reduction of yield and a great increase in production costs.

In order to overcome the problems of the prior art as described above, the present inventors have proposed an electrophotographic photoreceptor using an aluminum oxide layer as the charge transporting layer in JP-A No. 63-63051. As a result of further investigations, it has been found that more preferable results can be obtained if the aluminum oxide film is produced by a specified method.

SUMMARY OF THE INVENTION

The object of the present invention is to provide a method for producing an electrophotographic photoreceptor using an aluminum oxide layer as a charge transporting layer.

The present invention relates to a method for producing an electrophotographic photoreceptor which comprises the steps of forming a charge transporting layer comprising aluminum oxide on a substrate and then forming thereon a charge generating layer comprising mainly of amorphous silicon, or alternatively forming a charge generating layer comprising mainly amorphous silicon on a substrate and then forming thereon a charge transporting layer comprising aluminum oxide, wherein the charge transporting layer is formed using an aluminum or a compound containing aluminum by the ion plating method while maintaining the substrate at 50° C. or more.

DETAILED DESCRIPTION OF THE INVENTION

Reference will now be made, in detail, to preferred embodiment of the present invention, examples of which are set forth below.

As the substrate to be used in the present invention, both of electrically conductive substrates and electrically insulated substrates can be used. Electrically conductive substrates which can be used in the present invention include films or sheets of metals such as stainless steel and aluminum, or alloys. Electrically insulated substrates which can be used in the present invention include films or sheets of synthetic resins such as polyester, polyethylene, polycarbonate, polystyrene and polyamide; glass; ceramics; and paper. In the case of the electrically insulated substrate, it is necessary that at least a side in contact with other layer be made electrically conductive. This treatment to make electrically conductive can be achieved by, for example, vacuum deposition, sputtering or lamination of metal to be used in an electrically conductive substrate. The form of the substrate is not critical and may be cylindrical, belt-like or plate-like, for example. Moreover the substrate may be of multi-layer structure. The thickness of the substrate is determined appropriately depending on the characteristics of the electrophotographic photoreceptor to be produced usually, the thickness of the substrate is suitable to be 10 μm or more. Particularly preferably, the thickness of the substrate is from 0.1 to 5 mm.

On the substrate is formed a light-sensitive layer consisting of a charge transporting layer and a charge generating layer. Either of the layers may be formed first.

The charge transporting layer of the present invention is made of oxides of aluminum and does not substantially have light sensitivity in the visible light region, "Not having light sensitivity in the visible light region" means that the layer does not generate an electric charge carrier comprising a positive hole-electron pair upon irradiation with light having a wavelength falling within the visible light region. Thus the light-sensitive layer of the present invention is completely different in structure from an electrophotographic light-sensitive layer in which ZnO and $TiO_2$ are dispersed in a binder resin along with a sensitizing dye and an electrophotographic light-sensitive layer in which a deposited film of a chalcogen, e.g., Se, Se-Te and S and an a-Si film are laminated, which have been proposed in JP-A Nos. 55-87155 and 59-12446. The charge transporting layer of the present invention may have light sensitivity to ultraviolet light.

The charge transporting layer of the present invention is formed by the ion plating method, and this process of formation should be carried out while maintaining the substrate temperature at 50° C. or more. If the substrate temperature is less than 50° C., the charge transporting layer formed undesirably has a low film hardness. The substrate temperature is generally from 50° to 800° C., preferably from 100° to 600° C., and more preferably from 200° to 300° C.

A method of forming the charge transporting layer will hereinafter be explained.

Aluminum or aluminum oxides can be used as the raw material. The raw material is inserted in an oxygen-free copper crucible capable of being cooled with water, as provided in a vacuum vessel. In this case, if desired, oxygen gas may be separately introduced directly in the vacuum vessel. In connection with film forming conditions, the degree of vacuum in the vacuum vessel is from $1\times10^{-2}$ to $1\times10^{-7}$ Torr, the voltage applied to an ionization electrode is from +1 to +700 V, the voltage applied to an thermal electron filament is from 0 to 500 V, the current of the thermal electron filament is from 0 to 150 A, the bias voltage applied to the substrate is from 0 to −2,000 V, the electron gun voltage is from 0.5 to 20 KV and the electron gun current is from 0.5 to 1,000 mA. The substrate temperature is adjusted to 50° C. or more. The film thickness of the charge transporting layer comprising aluminum oxide can be controlled appropriately by controlling the ion plating time. In the present invention, the film thickness of the charge transporting layer is generally from 2 to 100 μm and more preferably 3 to 30 μm.

The charge generating layer contains amorphous silicon as the major component. The charge generating layer made mainly of silicon can be formed by the glow discharging method, the sputtering method, the ion plating method or the vacuum deposition method, for example. Although the film forming method is chosen appropriately depending on the purpose, a method in which silane ($SiH_4$) or silane-based gas is subjected to glow discharge decomposition according to the plasma CVD method is preferably employed. In accordance with this method, a film of relatively high dark resistance and high light sensitivity, containing a suitable amount of hydrogen therein can be formed, and preferred characteristics as the charge generating layer can be obtained.

The plasma CVD method will hereinafter be explained.

As the raw material for use in formation of the charge-generating layer containing amorphous silicon as the major component, silanes, e.g., silane and disilane are used. In forming the charge-generating layer, if desired, a carrier gas, e.g., hydrogen, helium, argon and neon can be used. For the purpose of controlling the dark resistance of the charge generating layer or controlling the charged polarity, an impurity element, e.g., boron (B) or phosphorus (P) can be added to the film by introducing a dopant gas, e.g., diborane ($B_2H_6$) gas, phosphine ($PH_3$) gas or the like to the above gas. Further, for the purpose of increasing dark resistance, light sensitivity or chargeability (charging ability or charged potential per unit film thickness), a halogen atom, a carbon atom, an oxygen atom, or a nitrogen atom, for example, may be incorporated in the charge generating layer. Furthermore, in order to increase the sensitivity in the long wavelength region, an element, e.g., germanium (Ge) and tin can be added. It is particularly desirable that the charge generating layer contains amorphous silicon as the major component and generally 1 to 40% by atom and preferably 5 to 20% by atom of hydrogen. The film thickness is generally from 0.1 to 30 μm and preferably from 0.2 to 5 μm. The charge generating layer may be provided on the charge transporting layer or below the charge transporting layer.

In the electrophotographic photoreceptor of the present invention, if desired, other layer may be formed on or below the charge generating layer and/or charge transporting layer assembly in an adjacent relation therewith. As these other layers, the following can be given.

As an charge blocking layer, a p-type semiconductor layer or an n-type semiconductor layer as obtained by adding Group III or V elements to amorphous silicon; or an insulated layer of e.g., silicon nitride, silicon carbide, silicon oxide or amorphous carbon can be used. As an adhesive layer, a layer as obtained by adding nitrogen, carbon, oxygen, etc. to amorphous silicon can be used. In addition, a layer containing elements of Groups IIIB and V at the same time, and a layer capable of controlling electric and image characteristics of the photoreceptor can be used. The film thickness of each of the above layers can be determined appropriately and usually it is within the range of from 0.01 to 10 μm.

In the present invention, to inhibit the injection of electric charge from the photoreceptor surface and substrate side to the charge transporting or charge generating layer and to obtain a photoreceptor having higher chargeability and low dark decay, an charge blocking layer may be provided between the substrate and the charge generating or charge transporting layer and/or on the surface of the photoreceptor.

Moreover, a surface protective layer to prevent charges in quality of the photoreceptor surface due to corona ions may be provided.

The above layers can be formed by the plasma CVD method. As described in the case of the charge generating layer, when an impurity element is added, a gas of a substance containing the impurity element is introduced into a plasma CVD equipment along with silane gas and is subjected to glow discharge decomposition. In formation of each layer, either of AC discharging and DC discharging can be effectively employed. In the case of AC discharging, for example, film forming conditions are as follows. That is, the frequency is usually from 0.1 to 30 MHz and preferably from 5 to 20 MHz, the degree of vacuum at the time of discharging is from 0.1 to 5 Torr (13.3 to 667 Pa), and the substrate heating temperature is from 50° to 400° C.

In the electrophotographic photoreceptor obtained by the present invention, it is not clear why the aluminum oxide layer acts as a charge-transporting layer. It is considered, however, that the oxide film has a function of efficiently injecting an electric charge carrier generated in the charge generating layer provided in contact therewith without trapping in the interface and at the same time, of preventing unnecessary injection of electric charge from the substrate side. Thus the electrophotographic photoreceptor has chargeability of about 45 V/μm or more and a dark decay rate as low as about 5 to 15%/sec.

In accordance with the present invention, as described above, a charge transporting layer comprising aluminum oxide is formed by the ion plating method while heating the substrate at 50° C. or more. Thus the charge transporting layer obtained has a high film hardness, and the electrophotographic photoreceptor obtained has good chargeability and a low dark decay rate. That is, the photoreceptor has chargeability of about 45 V/ μm or more and a dark decay rate as low as about 5 to 16%/sec, and further has high sensitivity.

The present invention is described in greater detail with reference to the following examples.

EXAMPLE 1

An a-Si:H (non doped) film was formed in a thickness of 1 μm on an aluminum pipe with a diameter of about 120 mm. That is, 200 ml/min of silane gas ($SiH_4$) was introduced into a capacitively coupled type plasma CVD apparatus and the pressure was maintained at 1.0 Torr. The substrate temperature was 250° C. Glow discharging was applied at a frequency of 13.56 MHz and an output of 270 W for 15 minutes.

Subsequently a layer of aluminum oxide was formed on the a-Si:H film by the ion plating method. That is, 99.99% alumina was placed in a water-cooled oxygen-free copper crucible and after maintaining the degree of vacuum at $2\times10^{-5}$ Torr, oxygen gas was introduced and the gas flow rate was controlled so that the degree of vacuum was maintained at $2\times10^{-4}$ Torr. The above aluminum pipe with the a-Si:H layer formed thereon was heated at 270° C., and a voltage of 8.5 KV was applied to an electron gun and a power output was set so that the current was 260 mA. At this time, the voltage of the ionization electrode was set at 80V, and a bias voltage of −500 V was applied to the substrate itself. The power of the electron beam was controlled so as to maintain the deposition speed at 36 Å/sec by the use of a quartz vibrator thick monitor provided in the vicinity of the substrate. In this manner, a film was formed over about 30 minutes, and taken out of the vacuum system to obtain a transparent film. The thickness of the aluminum oxide film was about 5.5 μm. The surface hardness of the electrophotographic photoreceptor obtained above was 710 in terms of Vickers hardness (load=10 g).

The sample obtained above was subjected to corona charging while rotating at 40 rpm. At a drum flow current of +20 μA/cm, the surface potential after 0.1 sec from the corona charging was about +295 V. The light energy required for a half decay of initial surface charges was 5.9 erg/cm$^2$ at 550 nm, and the residual potential at this time was about +33 V. The dark decay rate was 14%/sec.

The sample was placed on an ordinary paper copying machine ("Model 3500" manufactured by Fuji Xerox Co., Ltd.), and upon formation of images, there could be obtained clear and sharp images.

COMPARATIVE EXAMPLE 1

An electrophotographic photoreceptor was produced in the same manner as in Example 1 except that the ion plating was carried out while maintaining the aluminum pipe at room temperature (20° C.) without heating. The surface hardness of the electrophotographic photoreceptor was 640 in terms of Vickers hardness (load=10 g).

EXAMPLE 2

By the same manner as in Example 1 except that the order of deposition of films was reversed, a 5.5 μm thick aluminum oxide layer was formed and a 1 μm thick a-Si:H film was formed thereon. Subsequently, a 500 Å thick a-SiNx film as a surface protective layer was laminated in a plasma CVD apparatus.

The a-SiNx film was produced under the following conditions.

| | |
|---|---|
| Flow rate of silane | 50 ml/min |
| Flow rate of ammonia | 30 ml/min |
| Flow rate of hydrogen | 200 ml/min |
| Pressure in reactor | 0.5 Torr |
| RE Power | 80 W |
| Deposition time | 6 minutes |
| Substrate temperature | 250° C. |

The thus obtained sample was subjected to corona charging while rotating at 40 rpm. At a drum flow current of −20 μA/cm, the surface potential after 0.1 sec from the corona charging was about −340 V. The light energy required for a half decay of initial surface charges was 7.1 erg/cm$^2$ at 550 nm, and the residual potential was about −50 V. The dark decay rate was 13%/sec.

EXAMPLE 3

An a-Si:H (non-doped) film was formed in a thickness of 1 μm on an aluminum pipe with a diameter of about 120 mm. That is, 500 ml/min of silane gas ($SiH_4$) was introduced into a capacity bonded type plasma CVD apparatus and the pressure was maintained at 1.0 Torr. The substrate temperature was 250° C. Glow discharging was applied at a frequency of 13.56 MHz and an output of 400 W for 12 minutes.

Subsequently a layer of aluminum oxide was formed on the a-Si:H film by the ion plating method. That is, 99.99% aluminum was placed in a water-cooled oxygen-free copper crucible and after maintaining the degree of vacuum at $2\times10^{-5}$ Torr, oxygen gas was introduced and the gas flow rate was controlled so that the degree of vacuum was maintained at $8\times10^{-4}$ Torr. The above aluminum pipe with the a-Si:H layer formed thereon was heated at 250° C., and a voltage of 9.0 KV was applied to an electron gun and a power output was set so that the current was 400 mA. At this time, the voltage of the ionization electrode was set at 80 V, and a bias voltage of −600 V was applied to the substrate itself. Further, the AC current of 60 A was applied to the thermal electron filament (i.e., tungsten filament) which was provided in the vicinity of 12 mm from the upper part of the copper crucible to maintain the filament in a red heat state. The power of the electron beam was controlled so as to maintain the deposition speed at 30 Å/sec by the use of a quartz vibrator thick monitor provided in the vicinity of the substrate. In this manner, a film was formed over about 40 minutes, and taken out of the vacuum system to obtain a transparent film. The thickness of the aluminum oxide film was about 5 μm. The surface hardness of the electrophotographic photoreceptor obtained above was 780 in terms of Vickers hardness (load=10 g).

The sample obtained above was subjected to corona charging while rotating at 40 rpm. At a drum flow current of +20 μA/cm, the surface potential after 0.1 sec from the corona charging was about +350 V. The light energy required for a half decay of initial surface charges was 5.5 erg/cm$^2$ at 550 nm, and the residual potential at this time was about +45 V. The dark decay rate was 16%/sec.

The sample was placed on an ordinary paper copying machine ("Model 3500" manufactured by Fuji Xerox Co., Ltd.), and upon formation of images, there could be obtained clear and sharp images.

COMPARATIVE EXAMPLE 2

An electrophotographic photoreceptor was produced in the same manner as in Example 1 except that the ion plating was carried out while maintaining the aluminum pipe at room temperature (20° C.) without heating. The surface hardness of the electrophotographic photoreceptor was 570 in terms of Vickers hardness (load=10 g).

EXAMPLE 4

In the same manner as in Example 3 except that the order of deposition of films was reversed, an about 7 μm a-Si:H film was formed thereon. Subsequently, a 500 Å thick a-SiNx film as a surface protective layer was laminated in a plasma CVD apparatus.

The a-SiNx film was produced under the following conditions.

| | |
|---|---|
| Flow rate of silane | 200 ml/min |
| Flow rate of ammonia | 210 ml/min |
| Flow rate of hydrogen | 500 ml/min |
| Pressure in reactor | 1.0 Torr |
| RE Power | 200 W |
| Deposition time | 4 minutes |
| Support temperature | 250° C. |

The thus obtained sample was subjected to corona charging while rotating at 40 rpm. At a photoreceptor flow current of −20 μA/cm, the surface potential after 0.1 sec from the corona charging was about −380 V. The light energy required for a half decay of initial surface charges was 6.4 erg/cm$^2$ at 550 nm, and the residual potential was about −100 V. The dark decay rate was 15%/sec.

While the invention has been described in detail and with reference to specific embodiments thereof, it will be apparent to one skilled in the art that various changes and modifications can be made therein without departing from the spirit and scope thereof.

What is claimed is:

1. A method for producing an electrophotographic photoreceptor which comprises the steps of (1) forming a charge transporting layer comprising aluminum oxide on a substrate and then forming thereon a charge generating layer comprising mainly amorphous silicon, or alternatively (2) forming a charge generating layer comprising mainly amorphous silicon on a substrate and then forming thereon a charge transporting layer comprising aluminum oxide, wherein said charge transporting layer is formed using an aluminum or a compound containing aluminum by the ion plating method while maintaining the substrate at 50° C. or more.

2. The method for producing an electrophotographic photoreceptor as claimed in claim 1 wherein said substrate is maintained at from 100° to 600° C.

3. The method for producing an electrophotographic photoreceptor as claimed in claim 1, wherein the thickness of said charge transporting layer is from 2 to 100 μm.

4. The method for producing an electrophotographic photoreceptor as claimed in claim 1, wherein said charge generating layer is formed using glow discharge decomposition of silane ($SiH_4$) or silane based gas by the plasma CV method.

5. The method for producing an electrophotographic photoreceptor as claimed in claim 1, wherein said charge generating layer contains silicon as a major component and 1 to 40 atom % of hydrogen.

6. The method for producing an electrophotographic photoreceptor as claimed in claim 1, wherein the thickness of said charge generating layer is from 0.1 to 30 μm.

7. The method for producing an electrophotographic photoreceptor as claimed in claim 1, wherein said compound containing aluminum is aluminum oxide.

8. The method for producing an electrophotographic photoreceptor as claimed in claim 1, wherein said charge transporting layer is formed using aluminum oxide as a raw material while introducing oxygen gas.

9. The method for producing an electrophotographic photoreceptor as claimed in claim 1, wherein said charge tranporting layer is formed using aluminum as a raw material while introducing oxygen gas.

* * * * *

UNITED STATES PATENT AND TRADEMARK OFFICE

CERTIFICATE OF CORRECTION

PATENT NO. : 4,965,164

DATED : October 23, 1990

INVENTOR(S) : Yuzuru Fukuda et al.

It is certified that error appears in the above-identified patent and that said Letters Patent is hereby corrected as shown below:

Claim 4, Column 8, Line 32, change "CV" to --CVD--;

Claim 9, Column 8, Line 50, change "tranporting" to --transporting--.

Signed and Sealed this

Twentieth Day of October, 1992

*Attest:*

DOUGLAS B. COMER

*Attesting Officer*

*Acting Commissioner of Patents and Trademarks*